US005415532A

United States Patent [19]

Loughnane et al.

[11] Patent Number: 5,415,532

[45] Date of Patent: May 16, 1995

[54] HIGH EFFIECIENCY BALANCED OSCILLATING SHUTTLE PUMP

[75] Inventors: Michael H. Loughnane, Lafayette Hill, Pa.; William P. Wiesmann, Bethesda; Frederick J. Pearce, Olney, both of Md.; George P. Kearney, Durham, N.C.

[73] Assignee: The United States of America as represented by the Secretary of the Army, Washington, D.C.

[21] Appl. No.: 159,906

[22] Filed: Nov. 30, 1993

[51] Int. Cl.[6] ..... F04B 17/00

[52] U.S. Cl. ..... 417/411; 417/412; 417/477.3; 417/477.5; 417/477.7

[58] Field of Search ..... 417/411, 412, 475, 476, 417/477 B, 477 D, 477 E, 481

[56] References Cited

U.S. PATENT DOCUMENTS

| | | | |
|---|---|---|---|
| 4,012,178 | 3/1977 | Puckett | 417/478 |
| 4,014,318 | 3/1977 | Dockum et al. | 128/1 D |
| 4,170,439 | 10/1979 | Hase | 417/413 |
| 4,439,112 | 3/1984 | Kitsnik | 417/383 |
| 4,925,377 | 5/1990 | Inacio et al. | 417/472 |
| 4,995,864 | 2/1991 | Bartholomew et al. | 604/153 |
| 5,044,900 | 9/1991 | Cavallaro | 417/466 |
| 5,188,603 | 2/1993 | Vaillancourt | 604/131 |

*Primary Examiner*—Richard A. Bertsch
*Assistant Examiner*—Alfred Basichas
*Attorney, Agent, or Firm*—John Francis Moran

[57] ABSTRACT

A pump and a method for pumping liquid or fluid through a pair resilient tubes includes a shuttle block which partially compresses the tubes in a balanced, alternating manner. The resilient tubes are held in a parallel relationship with a predetermined space defined therebetween. Within the predetermined space, a shuttle block is oscillated along the linear axis to partially compress the tubes in an alternating fashion. As one of the two parallel tubes is compressed, fluid is pumped out of the tube and at the same time fluid is drawn into the second tube as the latter tube resumes its original shape. The resilience of both tubes also is used to assist the pumping action in a balanced fashion, thereby providing a pump that has low power consumption and is lightweight.

20 Claims, 4 Drawing Sheets

HIGH EFFIECIENCY BALANCED OSCILLATING SHUTTLE PUMP

BACKGROUND OF THE INVENTION

This invention relates in general to a high-efficiency oscillating shuttle pump, and in particular, to a lightweight portable shuttle pump characterized by low power consumption. Prior art pumps utilized in pumping liquid or fluids through tubes utilize a piston-type plunger which momentarily occludes the tubes to effect pumping. Such a prior art device used in circulatory assist devices is illustrated in U.S. Pat. No. 4,014,318. A prior art pump utilizing a series of pistons to successively compress, and completely occlude a tube which carries the liquid to be pumped is illustrated in FIG. 1. Pumping mechanism 10 pumps liquids through a tube 14. Three pumping pistons 11, 12 and 13 act in series to pump liquid through the tube 14. Piston 11 completely occludes tube 14. While tube 14 is held occluded, piston 12 compresses and occludes the tube 14 to urge liquid in the direction of arrow 15. The occlusion of piston 11 during compressions of tube 14 by piston 12 causes the liquid to be pumped in the desired direction. Similarly, piston 13 operates in conjunction with piston 12.

One drawback of prior art pumps is that the total occlusive nature of the pumping action reduces efficiency. Further, the occlusion utilized in such pumps has the effect of damaging cells when the pump is used to pump sensitive fluids such as blood. The shown piston relationship is relatively bulky and has a high power consumption.

SUMMARY OF THE INVENTION

An object of the instant invention is to provide a high-efficiency, lightweight portable pump which overcomes the drawbacks of prior art pumps. Another object of the instant invention is to provide a pump which is lightweight and portable and which may operate for long periods of time using limited power. Still another object is to provide a pump which is portable and battery powered. A further object of the invention is to provide a lightweight pump which provides a gentle pumping action, thereby providing low hemolysis if blood or other types of cells are being pumped. Still another object of the invention is to provide a pump containing pump-tube chambers which are easily removed and sterilized and which may be replaced as in a peristaltic pump. These and other objectives will be apparent from the following disclosure.

In order to achieve the above objectives, a pump is provided for pumping a fluid which includes: first and second resilient tubes each having an original shape; a means for holding the resilient tubes in a substantially parallel relationship to define a predetermined space between the tubes; a shuttle block having first and second sides adjacent to the first and second resilient tubes, respectively, positioned between the tubes in the predetermined space; a driver for driving the shuttle block linearly along an oscillation axis perpendicular to the first and second sides of the shuttle block to first and second positions so as to partially compress the first resilient tube when moved to the first position and to partially compress the second resilient tube when moved to the second position; and an input and output valve attached on the ends of each tube such that a first portion of the fluid is pumped out of the first resilient tube as the shuttle block compresses the first resilient tube while a second portion of the fluid is drawn into the second resilient tube as it resumes its original shape.

In another embodiment there is provided a method of pumping a liquid through a pair of resilient tubes each having an original shape and being held in a substantially parallel relationship to each other to define a space between the tubes, the method includes the steps of: arranging a shuttle block between the tubes; driving the shuttle block in a first direction along an oscillation axis to partially compress one of the resilient tubes; allowing a portion of the fluid to exit from an output end of the resilient tube as it is compressed; driving the shuttle block in a second direction along the oscillation axis to partially compress the other resilient tube as the first resilient tube resumes its original shape; allowing another portion of the fluid to exit from an output end of the second resilient tube as it is compressed while allowing a third portion of the fluid to enter the first resilient tube as it resumes its original shape.

In still another embodiment there is provided a pump which is used to pump a fluid made up of particles having of a predetermined or known size. The pump includes: a pair of resilient tubes each having an original shape; means for compressing one of the resilient tube so as to form a passage a particular size within the compressed tube; means for reciprocating the potential energy stored in the compressed tube to the compressing means as the compressed tube resumes is original shape in order to assist the compressing means as it compresses the second resilient tube; and means for causing part of the liquid to be forced out of one end of tube being compressed and for allowing new liquid to enter the opposite end of the tube as it resumes its original shape. In one embodiment, care is taken to ensure that the compressing of the tube does not define a passage which is smaller than the particle size. This type of pump is especially useful to prevent damage to cells when the pump is used to pump blood, for example.

BRIEF DESCRIPTION OF THE DRAWINGS

The above stated and other objectives will be readily apparent from the detailed description of the embodiments of the various inventions which are described below by reference to the following figures wherein.

DETAILED DESCRIPTION OF THE PREFERRED EMBODIMENTS

Figure 1:
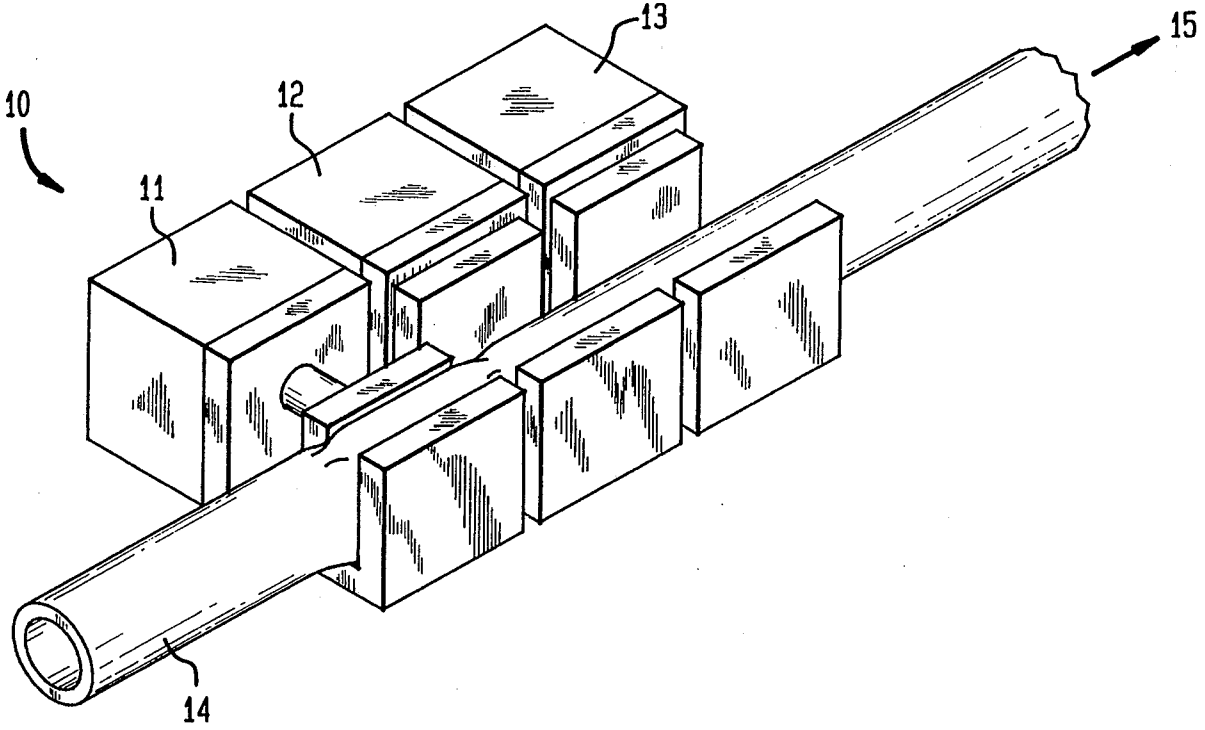
FIG. 1 (PRIOR ART)
FIG. 1 illustrates a prior art pump for pumping a fluid through a tube.

A shuttle pump according to an embodiment of the instant invention provides a very lightweight pump with very low power requirements. Such pumps may be used for the delivery of resuscitation fluids in situations where the portability of the pump is important such as emergency situations, combat casualties, etc, to eliminate the gravity-driven systems currently used. Another distinctive feature of the instant invention is its low power consumption. This makes it useful for delivery of tissue culture fluids to biocartridges used to grow cells aboard NASA's space shuttle vehicles. Under battery power, such a pump may be operated for long durations on the order of days to weeks.

The general operation of a shuttle pump according to an embodiment of the instant invention is illustrated in FIGS. 2A–2D. The shuttle pump is shown generally at reference numeral 100. The pump operates by partially compressing at least two parallel resilient tubes 101 and 102 in an alternating fashion against flat stops 105. Tubes 101 and 102 are compressed by the sides 106 of a linearly driven oscillating shuttle block 110. Input check valves 103 and an output check valves 104 are located on opposite ends of the resilient pumping tubes 101 and 102. The resiliency of tubes 101 and 102 is used to refill a partially emptied tube as the tube returns to its original shape and aids in the pumping action. This operation is more fully described below.

Figure 6B:
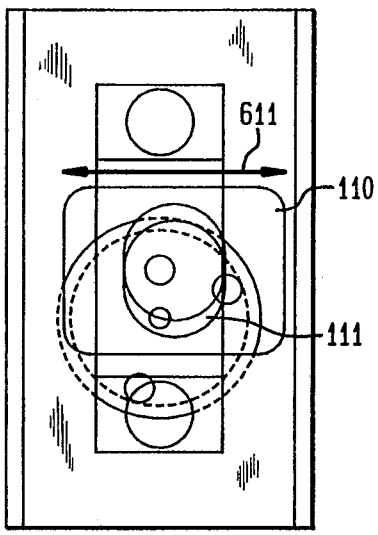
FIGS. 6A and 6B illustrate the shuttle block and motor configuration, respectively, for an embodiment according the instant invention.
Figure 6A:
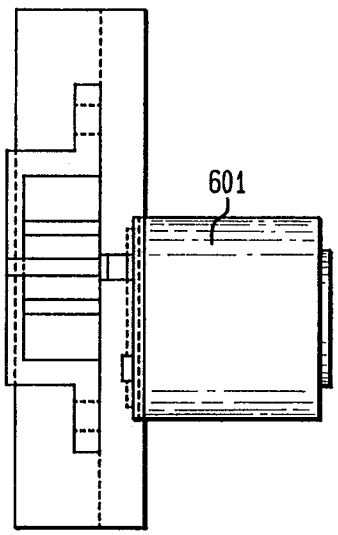

FIGS. 2A–2D shows the general operation of the pump 100 through a full cycle of the shuttle block 110. The shuttle guide is not shown for clarity of illustration. Fluid flows into and out of the tubes 101 and 102 as illustrated by the arrows. In this embodiment, as further illustrated in FIGS. 6A and 6B, the shuttle block 110 is driven by an eccentric 111 on the shaft of a high efficiency electric motor 601. The motor may be any suitable motor having the desired efficiency and driving characteristics. This motion produces an oscillating linear motion of the shuttle as shown by arrow 611 in FIG. 6B. The linear motion is sinusoidal in nature.

Efficient operation is achieved by the arrangement of the tubes 101 and 102 and the shuttle block 110. The balanced operation of the interaction of the shuttle block 110 and the tubes 101 and 102 adds to the pump's efficiency. Limiting the travel of the shuttle block 110 such that total occlusion of the tubes 101 and 102 never occurs (i.e., tubes 101 and 102 are only partially compressed at the end of the shuttle block's 110 motion in a particular direction), also increases efficiency and contributes to other beneficial characteristics of the pump as further described below.

Figures 2A, 2B, 2C, 2D:
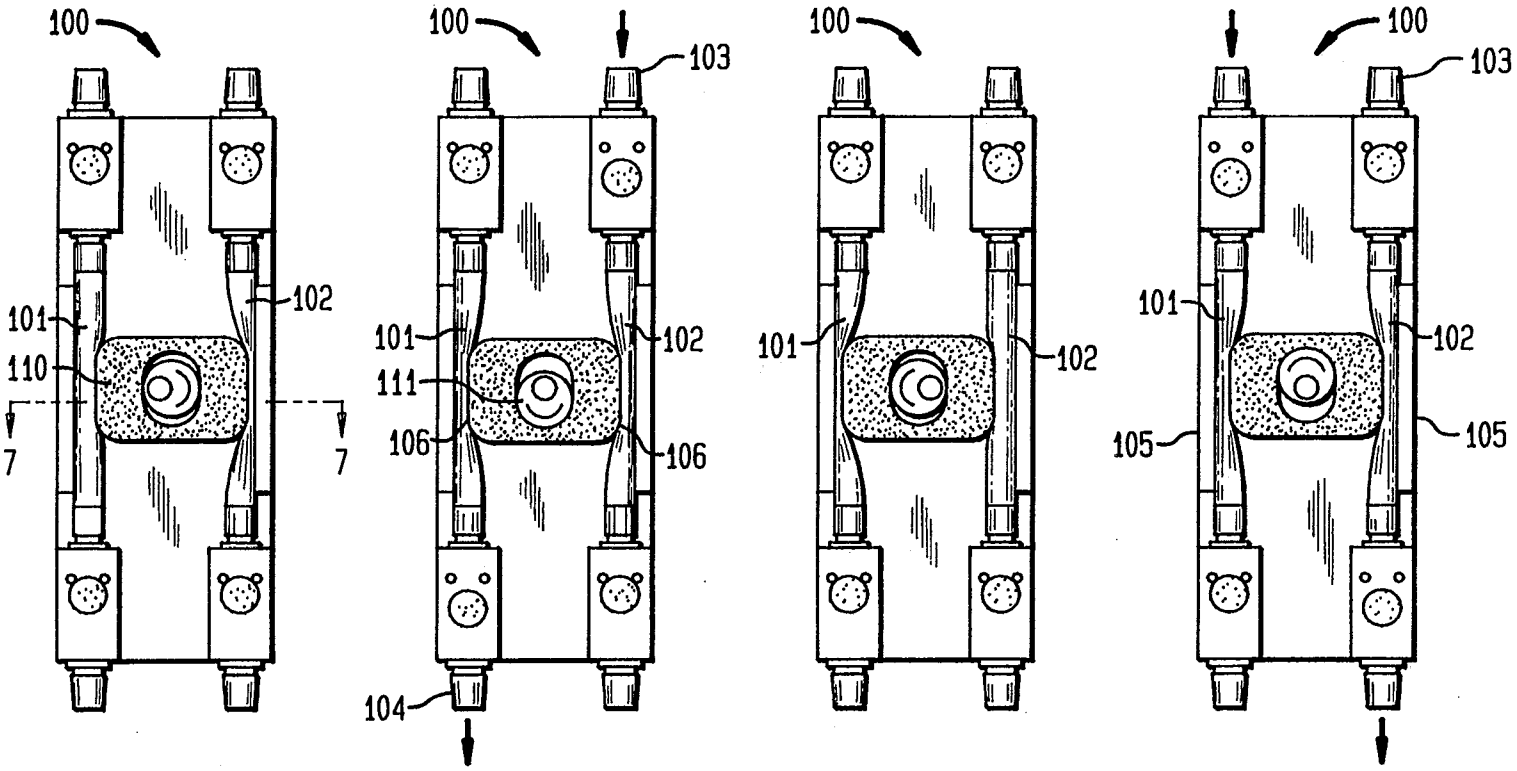
FIGS. 2A–2D illustrate the shuttle block and tube configuration and operation according to an embodiment of the instant invention.
Figure 3:
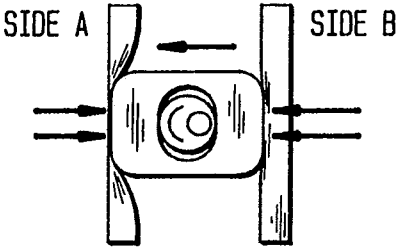
FIG. 3 illustrates a force description of the tube and shuttle block according to the balanced operation of an embodiment of the instant invention.
Figure 7:
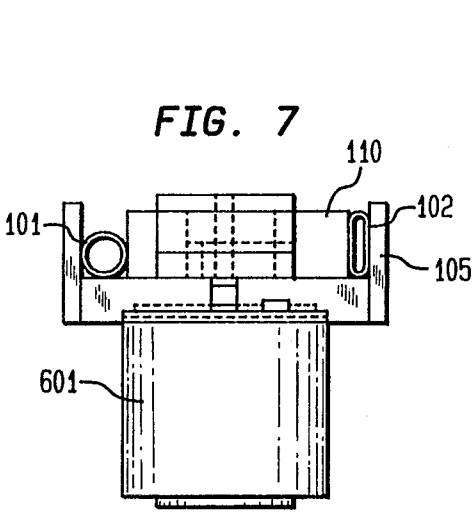
FIG. 7 illustrates a cross section of the shuttle block, tubes and motor according to an embodiment of the instant invention.

As illustrated in FIG. 2B, each of the tubes may be slightly compressed by the sides of the shuttle block 106 when the shuttle block 110 is in the center position. The operation of the pump 100 will be further described in connection with FIG. 2, along with FIG. 7 which illustrates a view along line 7–7. In FIG. 2A, the force delivered by the shuttle block 110 must overcome the resiliency of tube 102 ($F_{Ar}$) as well as the force produced by the pressure of the fluid which is located within tube 102 ($F_{Ap}$). Because of the balanced arrangement, while one tube 102 is being compressed the other tube 101 is expanding. The common shuttle block 110 experiences forces in opposite directions from the two tubes 101 and 102 and the force exerted by the fluid therein. In other words, the resiliency of the tubes 101 and 102 as well as the force of the fluid within the tubes reciprocates part of the force originally used to compress the tube, stored as potential energy in the system, back into the shuttle block 110. In this manner, the potential energy is used to aid the shuttle block 110 as it compresses the opposite tube. Thus, the only driving force which must be supplied by the motor 601 is the vector sum of these forces ($F_{net}$) (i.e., the difference between these forces) plus any additional force necessary to overcome frictional forces within the system. This relationship is depicted graphically in FIG. 3 and is represented by the equation:

$$F_{net}=F_{Ar}+F_{Ap}-F_{Bp}-F_{Bp}+F_{friction}$$

One advantage of the instant invention is that a significant portion of the stored potential energy held in the resilience of the tube is returned to the drive system during the refilling cycle. Refilling of tube 102 is shown in FIG. 2B. Additional liquid or fluid is drawn into the tube 102 through input check valve 103. A portion of the potential energy stored in compressed tube 102 is used to fill the interior chamber of tube 102, open the input check valve 103 and overcome frictional/viscous losses within the tube itself. The remaining portion of the potential energy is returned to the shuttle block 110.

The net force that the shuttle block 110 must deliver is essentially sinusoidal in amplitude, and reaches a maximum at the limits of excursion in either direction. Care is taken to not completely compress (occlude) the resilient tubes 101 and 102 at the end of the shuttle block 110 motion. Such total occlusion results in very high forces, is wasteful of energy and is not required for the pumping action. Further, when the pump is to be used to pump sensitive fluids such as blood, the instant design avoids damage to the cells, as is experienced with occlusive designs.

A working pump according to an embodiment of this invention was constructed as follows. Silastic pump tubing ($\frac{1}{8}''\times 3/16''$) manufactured by Manostat was used for tubes 101 and 102. The shuttle block 110, housing and connector were manufactured by Instech, Laboratories, Inc. A motor 601, Model 2020C produced by MicroMo Electronics was used. The choice of input and output check valves 103 and 104 depends upon desired pumping pressures and other parameters. Duckbill valves Model 1300–104 manufactured by Vernay Laboratories, Inc. are especially useful when the pump is used to pump blood in order to reduce any damage to the blood. Such a pump is small in size ($2''\times 3''$), light weight (60 gm) and has very low power consumption (60 Mw at 15 ml/min at $\Delta p=0$). Such a pump is also capable of delivering up to 40 ml/min unloaded (as it would be in an intravenous fluid delivery system).

The shuttle pump may also include a pump controller (not shown) to monitor the rotational speed of the pump or the flow rate and to control the shuttle block 110 movement. The speed controller may monitor the back emf of the motor 601 to automatically adjust the motor's operation to the proper back emf values, and thus, cause the pump to operate at a constant speed. Such a controller may be, for example, model S100 manufactured by Instech. The particular back emf value corresponding to the desired flow rate may be predetermined, for example, and the motor is then controlled until the particular back emf is achieved if operating characteristics corresponding to a particular fluid are known. Alternatively, the flow may be directly measured and the motor may be controlled until the desired flow rate is obtained.

As stated above, one factor contributing to the high efficiency of a pump according to the instant invention is the pump's use of a balanced operating arrangement. The principle behind the balanced operation may be more readily understood according the following spring model. The use of springs provides a reasonable approximation for the resilient tubes 101 and 102.

Figure 4A:
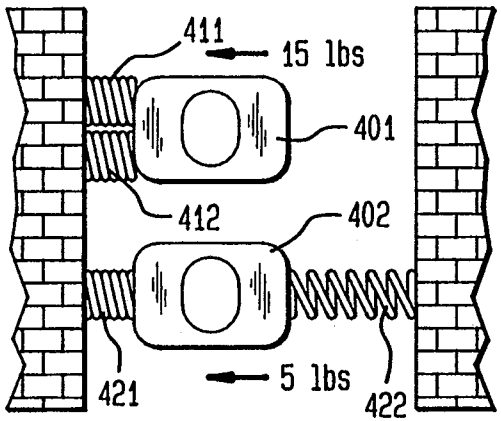
FIGS. 4B and 4C illustrate a spring model of the balanced operation embodied in the instant invention.
Figure 4B:
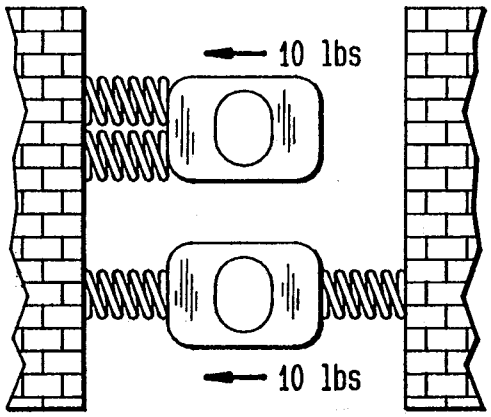
Figure 4C:
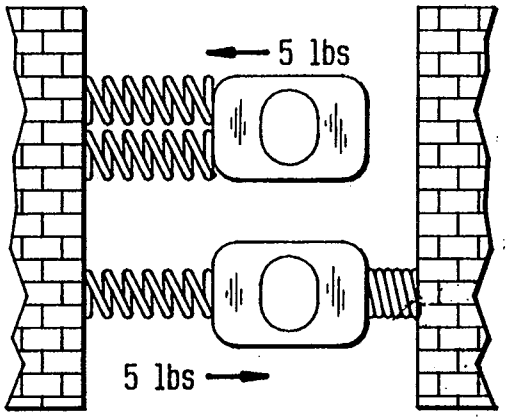

A comparison is based on the two spring models shown in FIGS. 4A, 4B, and 4C. The top half of FIGS. 4A, 4B, and 4C depicts two springs 411 and 412 on the same side of driving block 410. This approximates a pumping action which-utilizes a piston driven against a single tube. The lower half of FIGS. 4A, 4B, and 4C illustrates the two springs 421 and 422 on each side of block 402. This arrangement models the balanced operation of the instant invention. Both arrangements would result in equal flow rates. Work requirements for one half cycle of single sided and balanced arrangement are calculated below. The other half of the cycle is identical. Frictional losses are neglected in this analysis. The spring model uses a preload. This preload corresponds to the partial compression by shuttle block sides 106 on both tubes 101 and 102 when the shuttle block 110 is in center position as illustrated in FIG. 2B as well as the internal pressure that the liquid exerts on the tubes as a result of the source hydrostatic pressure.

The following assumptions are used for the model:

All springs are identical and have a spring constant $k=10$lbs/in;

Springs have a resting length of 1";

Springs start compressed to 0.5"at center point of excursion;

Shuttle excursion is +/- 0.25";

The amount of compression denoted by x; and

Force generated by any of the springs is given by $F=kx$.

While both arrangements exhibit a difference in force of 10lbs from end to end, the work performed to achieve these two states is different. Work is defined as follows:

$$\text{Work} = \int_{x1}^{a} F\,dx$$

Since the springs are linear devices, measuring the area under the force-displacement curve is equivalent to calculating the integral. Since power is work/time, work ratios are the same as power ratios.

Figure 5B:
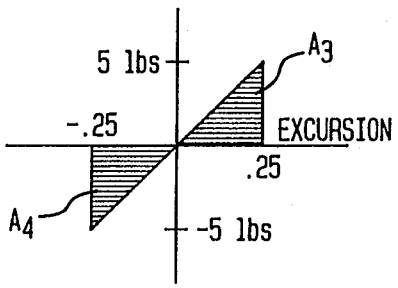
FIGS. 5A and 5B illustrate a force displacement plot for the single-sided pumping arrangement and the balanced pumping arrangement, respectively shown in FIGS. 4B and 4C.
Figure 5A:
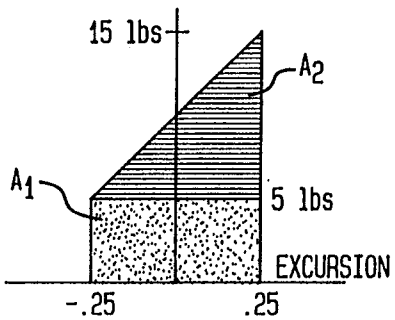

From FIG. 5A we see that, $A_1=0.5\times5=2.5$ in-lbs (results from preloading of springs) and $A_2=\frac{1}{2}\times10\times0.5=2.5$ in-lbs. The total work$=A_1+A_2=5$ in-lbs for the single sided configuration. At best, if all preloading was eliminated, the work will reduce to 2.5 in-lbs, i.e., $A_1=0$.

From FIG. 5B we see that $A_3=A_4=\frac{1}{2}\times0.25\times5=0.625$ in-lbs. In the balanced case, the magnitude of the preload has no effect on the work performed as long as k and displacement are unaltered.

As the above comparison illustrates, the power requirements would be 4 times higher for the single sided approach and will never go below 2 times higher, even if all preloads could be eliminated. The second order effects such as frictional losses will also be reduced in the balanced situation since the absolute value of the forces involved are less. Part wear is also lower.

As the pressure increases inside of the pumping tubes, to a first order approximation, it is similar to increasing the spring constant from k to (k+kp) and thereby increasing the preload. Again, the balanced pump arrangement only requires that the driving mechanism overcome the difference in resiliency forces and the difference in pressure forces. While the ratio of power required will remain unchanged, the difference of the absolute value of the power requirements will increase. For example, doubling k to 2k because of increased pressure, will increase single sided work to 10 in-lb and balanced work to 2.5 in-lb. The ratio will still be 4:1 but the work difference will now be 7.5 in-lb instead of 3.75 in-lb.

The above description of an embodiment of the invention should not be considered as limiting. Many modifications and uses of the principles set forth herein are possible.

One advantage of this design is the ease in which the tubes 101 and 102 can be replaced. This facilitates easy removal, sterilization and replacement of the tubes where required.

Another important aspect of this design is also its excellent characteristics with regard to pumping cells or blood. The non-occlusive aspect of the shuttle pump design avoids the cell damage associated with occlusive designs which cause high shear stresses and cellular damage. To achieve minimum cellular damage, the compression of the tubes is controlled such that a space equal to or larger than the particle size of the cell is left at all times in the tubes. This is possible since total occlusion is not necessary to generate the pumping action. The gentle pumping action of the instant pump provides low hemolysis when blood is being pumped. Damage to cells may still occur in the valves, and in areas of high shear forces and by interaction with the pump materials. By using duck-bill type valves and appropriate material for the tubes, hemolysis is minimized. In such an embodiment the only point of occlusion is the very tip or edge of the duck bill.

This pump is also small enough to be easily portable. For example, in combat situations, each soldier would be able to carry his own resuscitation pump. Medics or other emergency personnel would be able to carry a number of pumps without undue weight.

In another embodiment of the pump, the pumping capacity is increased. If, for example, the pump is to be used for resuscitation purposes, the design should be modified. While a pump which delivers up to 40 ml/min unloaded (as it would be in an intravenous fluid delivery system) is adequate for maintenance of a moderately stable patient, it would need to be about 5 times this for aggressive resuscitation efforts. This scaling up can be accomplished by increasing the footprint of the shuttle block and the diameter of the pump tubes. This scaled up version would require more power. Doubling the diameter of the tubes, for example, would theoretically give a 4-fold increase in flow rate with the same block size. More than one pump may be used together to achieve higher pumping capacity.

The above described pump configures the flow in the two tubes to be in the same direction so the flow profile looks like a sine wave with the peak pressure equal to the cracking pressure of the check valve plus the hydrostatic back pressure and the minimum equal to the inlet pressure. If precisely metered flow is required, care must be taken to account for the feature of this design resulting from free flow if the inlet pressure exceeds the check valve cracking pressure plus the outlet pressure.

In another embodiment of the instant invention the pump tubes can also be arranged to flow in opposite directions. This configuration creates a "push-pull" flow situation which would smooth out the pulsating nature of the flow in a closed system and reduce the ripple effect.

While the above description particularly describes the use of the pump in a medical environment, many other applications are possible. The instant pump has been found very efficient for the pumping of viscous and abrasive fluids. Pumping of abrasive fluids is improved by the non-occlusive nature of the pump. If the passage through a compressed tube is larger than the abrasive particle, wear will be minimized while maintaining efficient pumping action. The pump may be used for pumping tissue culture medium for ground based and space applications. Pumping whole blood or any other type of biological cells for cell culture applications and for toxicological testing may also be accomplished. The pump may be used for pumping viscous detergents into grease traps at timed intervals. This also works best when the compression of the tubes leaves a passage through a compressed tube which is as large or larger than the grease particles.

Due to the low power requirements the pump could be solar powered where other power sources are not practical or available. For example, such a pump may be used to deliver plant food to trees on a timed interval where a small solar panel could provide enough power for the brief periods required.

In many arrangements, very small amounts of energy is required to operate the valves. Such pumps become highly efficient.

The output from the instant pump inherently provides two pumping lines. The lines may be used independently or may be combined to provide twice the flow of a single line with a lower ripple factor. Output from multiple pumps in parallel could also be combined.

In another embodiment, the pump may include means for pressurizing the inlet side which will cause both valves to open and fluid to freely flow through the pump at any shuttle position. This allows for easy priming and clearing of air bubbles in pumps where the input pressure+valve cracking pressure is less than the output pressure.

In still another embodiment, more than 1 tube/side can be accommodated by geometry alterations. For example, four tubes may be used instead of two. A pair of tubes may be placed side by side on each side of the shuttle block. The shuttle block would have a thickness sufficient to compress the pair of tubes simultaneously. Alternatively, the single driving motor may be used to drive more than one shuttle block. Two blocks, each arranged as described above may be attached to a single drive shaft. Many variations of the geometry of the pump can accommodate the features of the instant invention.

In still other applications, with some sacrifice in efficiency, the flow rates on either side may be altered by unbalancing shuttle excursion or shuttle width, by altering the size of the tubes used or by some combination thereof. Additionally, flow rate through one tube may be altered by increasing the distance between the tube and the flat stop. In this manner the motor speed is unaltered while different flow rates through the tubes can be obtained. The flat stop may also be made adjustable so that tubes of different diameter can be used in a single pump. Further, adjusting the size of the flat stop to be smaller than the tube diameter can be used to adjust the pump's flow rate.

These and other uses of the instant invention are possible as defined by the appended claims.

What is claimed is:

1. A pump for pumping a fluid comprising:

a first resilient tube and a second resilient tube each having original shapes;

means for holding said first resilient tube and said second resilient tube in a substantially parallel relationship to each other and defining a predetermined space therebetween;

a shuttle block positioned within said predetermined space and having a first side and a second side adjacent said first resilient tube and said second resilient tube, respectively;

driving means for driving said shuttle block linearly along an oscillation axis to first and second positions, said oscillation axis being perpendicular to said first side and said second side of said shuttle block, said shuttle block partially compressing said first resilient tube when moved to said first position and partially compressing said second resilient tube when moved to said second position;

a first input valve connected to one end of said first resilient tube and a first output valve connected to an opposite end of said first resilient tube; and a second input valve connected to one end of said second resilient tube and a second output valve connected to an opposite end of said second resilient tube, wherein a first portion of said fluid is pumped out of said first resilient tube through said first output valve as said shuttle block compresses said first resilient tube while a second portion of said fluid is drawn into said second resilient tube through said second input valve as said second resilient tube resumes its said original shape.

2. A pump as recited in claim 1, wherein said driving means comprises a high efficiency electric motor.

3. A pump as recited in claim 2, wherein said electric motor is powered by a battery power source.

4. A pump as recited in claim 2, wherein said driving means further comprises:

a rotating shaft extending from said electric motor; and an eccentric means on an end of said rotating shaft for engaging said shuttle block and converting rotational motion of said rotating shaft into linear motion of said shuttle block.

5. A pump as recited in claim 2, further comprising motor control means connected to said electric motor for monitoring back emf of said electric motor and automatically adjusting the operation of said electric motor until said back emf equals a predetermined value.

6. A pump as recited in claim 2, wherein said electric motor is solar powered.

7. A pump as recited in claim 1, wherein said first and said second input valves and said first and said second output valves comprise check valves.

8. A pump as recited in claim 7, wherein said check valves are duckbill check valves.

9. A pump as recited in claim 1, wherein said fluid flows through said first resilient tube in a first direction and said fluid flows through said second resilient tube in a second direction opposite to said first direction.

10. A pump as recited in claim 1, further comprising a third resilient tube and a fourth resilient tube adjacent said first resilient tube and said second resilient tube, respectively, wherein said first side and said second side of said shuttle block partially compress said third resilient tube and said fourth resilient tube, respectively, as said shuttle block moves along said oscillation axis.

11. A pump as recited in claim 1, further comprising:
a third resilient tube and a fourth resilient tube; and
a second shuttle block arranged between said third resilient tube and said fourth resilient tube and connected to said driving means, said driving means for driving said second shuttle block against said third resilient tube and said fourth resilient tube in an alternating fashion so as to pump a portion of said fluid through said third resilient tube and said fourth resilient tube.

12. A method for pumping a fluid through a first resilient tube and a second resilient tube each having original shapes and held in a substantially parallel relationship to each other and having a predetermined space defined therebetween, said method comprising the steps of:
(a) arranging a shuttle block in said predetermined space;
(b) driving said shuttle block in a first direction along an oscillation axis to partially compress said first resilient tube;
(c) discharging a first portion of said fluid from an output end of said first resilient tube as said driving step (b) partially compresses said first resilient tube;
(d) driving said shuttle block in a second direction along said oscillation axis to partially compress said second resilient tube and to allow said first resilient tube to resume its said original shape;
(e) discharging a second portion of said fluid from an output end of said second resilient tube as said driving step (d) partially compresses said second resilient tube; and
(f) introducing a third portion of said fluid into said first resilient tube as said first resilient tube resumes its said original shape.

13. A method as recited in claim 12, wherein said driving step (b) and said driving step (d) further comprise the steps of:
rotating a shaft having an eccentric on one end, about a rotation axis, said rotation axis being perpendicular to said oscillation axis; and
engaging said shuttle block with said eccentric such that rotational energy of said shaft is converted into linear oscillating energy in a direction of said oscillation axis.

14. A method as recited in claim 12, further comprising the steps of:
determining a desired back emf value of a motor for driving said shuttle block wherein said desired back emf value corresponds to a desired flow rate of said fluid;
monitoring actual back emf of said motor as said motor drives said shuttle block; and
comparing said actual back emf with said desired back emf value and automatically adjusting the operation of said motor so that said actual back emf equals said desired back emf value.

15. A method as recited in claim 12, wherein said fluid includes biological cells and wherein said discharging step (c), said discharging step (e), and said introducing step (f), further comprise the steps of discharging a first portion of said fluid under low pressure, discharging a second portion of said fluid under low pressure, and introducing a third portion of said fluid under low pressure, respectively, so that damage to said biological cells is minimized.

16. A method as recited in claim 12, wherein said driving step (b) and said driving step (d) further comprise the step of utilizing a force exerted by fluid within a compressed tube to urge the shuttle block in a direction away from said compressed tube.

17. A method as recited in claim 15, wherein said driving step (b) and said driving step (d) further comprise the step of utilizing a force exerted by the resiliency of a compressed tube to urge the shuttle block in a direction away from said compressed tube.

18. A pump for pumping a fluid composed of particles of a first size, said pump comprising:
a first resilient tube and a second resilient tube each having an original shape and receiving said fluid;
means for compressing said first resilient tube into a compressed tube having a passage defined therethrough of a second size;
means for reciprocating potential energy that is stored in said first resilient tube when said first resilient tube is compressed, to said compressing means as said first resilient tube resumes its said original shape wherein reciprocated potential energy aids said compressing means in a subsequent compression of said second resilient tube; and
means for discharging a first portion of said fluid from a first end of said first resilient tube as said compressing means compresses said first resilient tube and for introducing a second portion of said fluid to an opposite end of said first resilient tube as said first resilient tube resumes its said original shape.

19. A pump as recited in claim 18, wherein said second size of said passage of said compressed tube is of equal or greater size than said first size.

20. An apparatus for pumping a fluid through a first resilient tube and a second resilient tube each having original shapes and held in a substantially parallel relationship to each other and having a predetermined space defined therebetween, said apparatus comprising:
means for arranging a shuttle block in said predetermined space;
means for driving said shuttle block in a first direction along an oscillation axis to partially compress said first resilient tube;
means for discharging a first portion of said fluid from an output end of said first resilient tube as said driving means partially compresses said first resilient tube;
said driving means being for driving said shuttle block in a second direction along said oscillation axis to partially compress said second resilient tube and to allow said first resilient tube to resume its said original shape;
means for discharging a second portion of said fluid from an output end of said second resilient tube as said driving means partially compresses said second resilient tube; and
means for introducing a third portion of said fluid into said first resilient tube as said first resilient tube resumes its said original shape.

* * * * *